United States Patent [19]

Platt

[11] 4,143,832

[45] Mar. 13, 1979

[54] THREAD DISPENSER

[76] Inventor: Ellis F. Platt, 10555 W. Beaver St., Jacksonville, Fla. 32220

[21] Appl. No.: 798,363

[22] Filed: May 19, 1977

[51] Int. Cl.[2] ..... B65H 49/00

[52] U.S. Cl. ..... 242/129.62; 242/157.1

[58] Field of Search ..... 242/129.62, 134, 136, 242/137.1, 139, 157.1, 158 R

[56] References Cited

U.S. PATENT DOCUMENTS

| | | | |
|---|---|---|---|
| 1,387,300 | 8/1921 | Oliver et al. | 242/136 |
| 2,025,988 | 12/1935 | Kalff | 242/157.1 |
| 2,733,877 | 2/1956 | Cunningham | 242/139 |
| 3,228,627 | 1/1966 | Bass | 242/129.62 |
| 3,722,827 | 3/1973 | Hrescak | 242/157.1 |

*Primary Examiner*—Leonard D. Christian

*Attorney, Agent, or Firm*—George H. Baldwin; Arthur G. Yeager

[57] ABSTRACT

An improved dispenser for a strand which has been twine-wound about a hollow spool to form a ball may be fabricated from a ball mounting means adapted to horizontally and rotatably mount the ball interiorly of the central hollow of the spool, an elongated fairlead support means having a fairlead support shaft portion of a length greater than that of the ball, extending substantially parallel to the central hollow of the spool, and spaced from the ball exterior and having a mounting stem portion pivotally connecting the support shaft portion is pivotable about a portion of the surface of the ball, and a strand-guide fairlead rotatably and reciprocably mounted to the support shaft portion of the support means so as to be reciprocable along the length thereof and rotatable thereabout.

10 Claims, 2 Drawing Figures

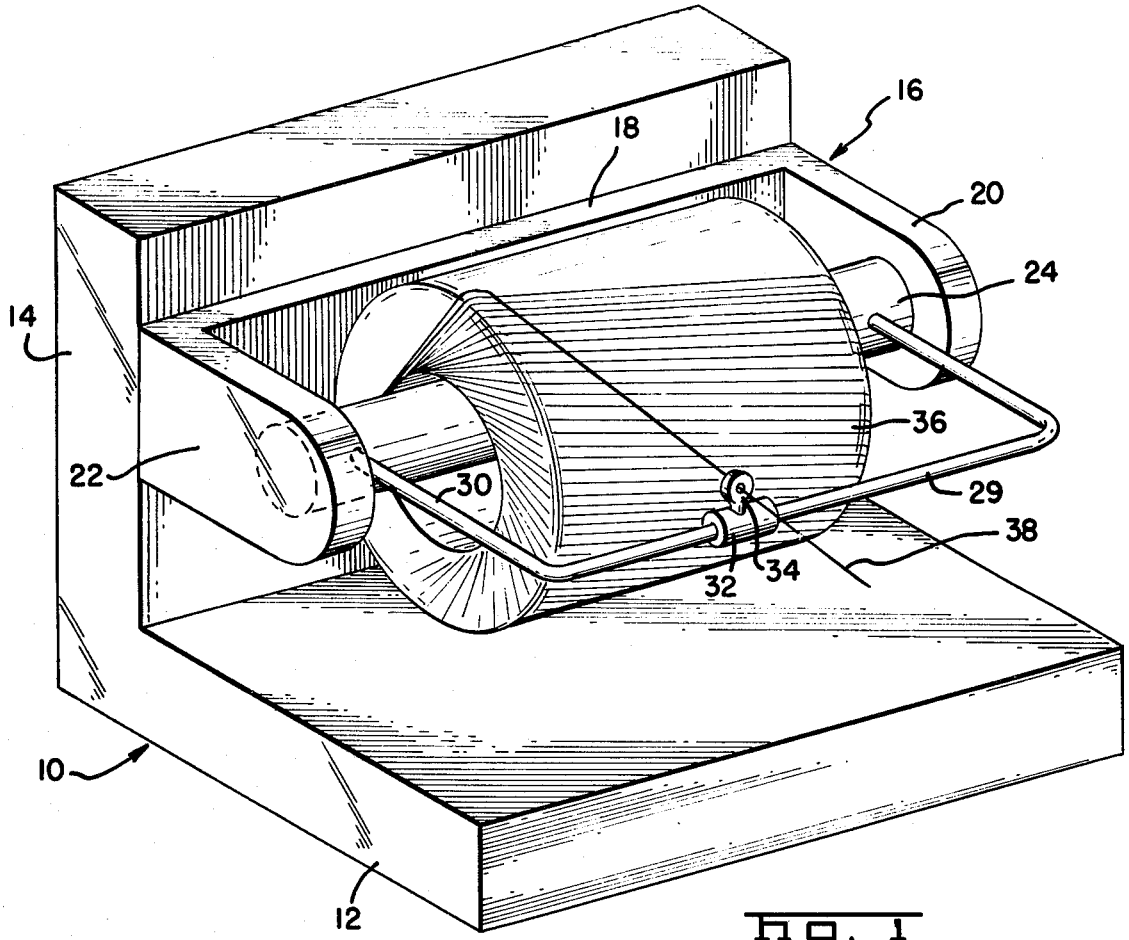
Fig. 1
Fig. 2
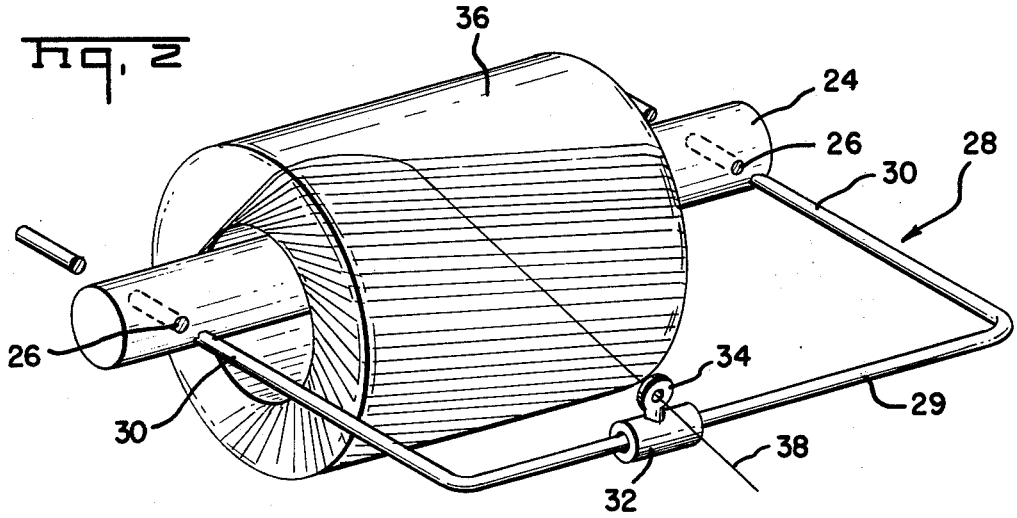

THREAD DISPENSER

BACKGROUND OF THE INVENTION

This invention relates generally to dispensers for strands and particularly to dispensers for a strand which is twine-wound on a spool.

As is well known to those skilled in the art, thread, as well as other linearly extended strands such as wire or the like, may be assembled for sale in several different manners. Strands such as sewing thread are level-wound along the length of a spool and may be readily dispensed therefrom by rotation of that spool about its central axis. As another alternative, a strand such as twine and crochet thread, may be wound upon a "ball", not levelly as with sewing thread, but rather in a direction parallel to the longitudinal axis of a spool while the spool is rotating about the axis. The "ball" resulting from such a winding process has the strand passing tangent to one side of the rotational axis at one end of the ball and tangent to the opposite side of the axis at the other end of the ball. For the purposes of the following discussion, a "ball" wound in this last mentioned manner will be termed "twine-wound". While twine-winding the thread about the ball may be convenient for the packaging of the thread, dispensing the thread from such a ball has plagued users.

The difficulty associated with unwinding thread from this type of ball is particularly aggravated in the case of crochet thread where an individual crocheter is attempting to remove thread continuously from the ball during the crocheting process. As will be appreciated by those skilled in the art, the thread is easily removable from such a ball at all points intermediate the ends of the ball. At these ends, however, the ball, of necessity, must rotate about its axis through at least a half-revolution in order for the thread on the opposite side of the ball to be removed. Such half-rotation is made extremely difficult by virtue of the fact that the ball is generally resting on a portion of the thread. This difficulty results in the slowing down of the crocheting process and in potential mistakes by the crocheter due to the necessity of periodic tugging of the thread in order to rotate the ball.

Various dispensers have been devised which mount a reel or ball on a central axle in order to relieve the weight of the ball from that portion of its exterior which carries the thread. Such a device is shown in U.S. Pat. No. 2,733,877 to Cunningham, which shows a horizontal axis for mounting a yarn or thread ball. U.S. Pat. No. 1,505,623 to Burton shows a vertical axis to which the ball is mounted and which prevents the ball from lateral displacement during dispensing. While the Burton and the Cunningham devices relieve the thread of the pressure which would result from the ball laying directly on its side, both suffer from the disadvantage that the thread coming off a twine-wound ball will have a tendancy to "tie up" about the ends of the axle if rotation is not constant. Neither the Burton or the Cunningham device is capable of the preventing such a ball end tie up.

U.S. Pat. No. 1,174,637 to Stupfell discloses a vertical axis mounted on a base together with a thread guide which is coaxially rotatable about the ball through 360°. In addition, there is included means for adjusting the position of the thread guide along the longitudinal axis. Nevertheless, despite the existence of a variable position thread guide, the use of a vertical axle necessarily results in the weight of the thread ball being placed on a portion of the thread on one end of the ball, thereby restricting the removability of the thread from that end. In addition, while the thread guide is rotatable throughout 360°, its variability along the longitudinal axis only extends over approximately half of the length of the ball.

Finally, U.S. Pat. No. 3,228,627 to Bass discloses a support for spools containing wire to facilitate unwinding wire, which comprises a base, a vertically upright "U-shaped" member, having sockets on the upper ends of the "U" for supporting the axle or spindle of the spool of wire. A second U-shaped member is pivotally mounted to the top of the first U-shaped member at a position outwardly adjacent of the sockets. The "base" of this second U-shaped member comprises two spaced parallel rigid wires over an intermediate portion of the length thereof which wires act as guide means for the wire being unwound. The second U-shaped member is coaxially pivotable through 180°. In addition the first U-shaped member is horizontally rotatably mounted to the base so as to be rotatable through 360°.

While the Bass support may result in a smooth dispensing of wire from a level wound spool, the device is unsuitable for dispensing twine-wound thread from a ball due to the fact that the thread guide located in the base of second U-shaped member extends only over the central portion of that ball and is, therefore, ineffective in alleviating the particular difficulties in dispensing thread which passes tangentially about the ends of the ball, specifically the tying-up of the thread behind and beneath the axle.

Since none of the devices disclosed in the references cited hereinabove, nor, indeed, any commercially available device is apparently capable of smoothly dispensing crochet thread from a twine-wound ball thereof, the need exists for such a dispenser which will not only allow such a smooth dispensing, but which also will be readily fabricated from inexpensive materials and easily maintained.

SUMMARY

It has now been discovered that a strand, such as crochet thread or the like, may be dispensed from a twine-wound ball without the conventionally encountered ball end tie-ups by utilizing a dispenser which includes a base for horizontally and rotatably mounting the ball, a fairlead support shaft mounted in parallel spaced relation to the ball so as to be pivotable about a portion of the ball surface parallel to the longitudinal axis of the ball and having a length not less than the length of the ball of thread, and a thread guide fairlead rotatably mounted to the fairlead support shaft and reciprocably movable along the length thereof.

BRIEF DESCRIPTION OF THE DRAWING

The noval features which are believed to be characteristic of this invention are set forth with particularity in the appended claims. The invention itself, however, both as to its organization and method of operation, together with further objects and advantages thereof, may best be understood by reference to the description taken in connection with the accompanying drawing, in which:

FIG. 1 is a perspective view of a dispenser constructed in accord with the invention with a ball of twine-wound thread mounted thereon; and FIG. 2 is a perspective view of a portion of said dispenser.

DESCRIPTION OF THE PREFERRED EMBODIMENT

Referring to FIG. 1, there is seen a crochet thread dispenser constructed in accordance with the invention having ball mounting means comprising an L-shaped support base 10 having a horizontal portion 12 and a vertical portion 14. Rigidly mounted to said vertical portion 14 is an arm assembly 16 having a spacer 18 and two resilient elongated axle support arms 20 and 22 mounted to spacer 18 and extending generally perpendicularly outwardly in parallel spaced relation therefrom. An elongated ball mounting axle 24 is horizontally rotatably held between arms 20 and 22, generally parallel to spacer 18 and mounting base 12.

Referring to FIG. 2 it is seen that rotatable axle 24 has two small bore holes 26 therethrough, one hole adjacent each end of axle 24. Fairlead support means 28 is shaped so as to form fairlead support shaft 29 and two parallel mounting stems 30, which stems 30 are securingly inserted in holes 26 so as to orient fairlead support shaft 29 generally parallel to ball mounting axle 24.

A thread guide fairlead 32 having eyelet 34 is rotatably and reciprocably mounted on fairlead support shaft 29. Finally a ball of twine-wound crochet thread or the like 36, having an individual strand 38, is mounted on axle 24 with strand 38 threaded through eyelet 34 of thread guide fairlead 32.

Having described the individual elements of the dispenser and their method of interconnection, the functioning of the invention will be obvious to those skilled in the art from the following description.

A ball 36 of twine-wound thread or the like is mounted to elongated ball mounting axle 24 by inserting the axle through the central hollow of the ball so as to expose the ends of the axle, and the holes 26 therethrough, on either end of the ball. The axle carrying the ball is then mounted between the outwardly extending ends of support arms 20 and 22 so as to be rotatable about its longitudinal axis and to have holes 26 exposed inwardly adjacent of each support arm. Thread guide fairlead 32 is mounted to fairlead support shaft 29 so as to be easily reciprocably displaceable therealong and rotatable thereabout. Mounting stems 30 of U-shaped member 28 are inserted in holes 26 to a depth such that fairlead support shaft 29 is spaced from, and generally parallel to, the surface of ball 36. The end portion 38 of thread from ball 36 is unwound from the ball and inserted through eyelet 34 of thread guide fairlead.

Horizontal portion 12 of support base 10 is placed near an operator at any convenient height such as on the floor or a table and the device is positioned so as to direct the horizontal portion 12 toward the operator. As the operator withdraws thread from the ball through eyelet 34, tension is placed on the end portion of the thread 38, which tension will rotate thread guide fairlead 32 until eyelet 34 is oriented toward the user. Additional tension will cause the fairlead support shaft 29 to move or rotate about the surface of ball 36 a limited amount, and thereby longitudinally rotate horizontal ball mounting axle 24 the same limited amount, until the fairlead support shaft portion of the support means is aligned with the pull of the thread by the operator. Due to the resilient force applied to the ends of the axle by the support arms, the axle, and therefore the support means, will be held in position oriented toward the operator.

As thread is withdrawn from the ball, thread guide fairlead will slide along shaft 29 until it reaches one end thereof. At this point, continuing tension on the thread will cause the ball to be rotated approximately 180° about the axle as the thread tangent to the axle is withdrawn. When the 180° rotation is completed, ball 36 will remain in position as thread is withdrawn from the portion of the surface facing the operator and the thread guide fairlead will reciprocate back along shaft 29 to the other end thereof where the rotation process is repeated.

By functioning in the above described manner, the fairlead 32 and support shaft 29 support the thread such that a portion of the weight of the thread extending between the ball and the operator is carried by the shaft 29 and through stems 30, by axle 24. In addition, the ability of the fairlead to traverse the entire length of the shaft 29 allows it to position itself opposite the end of the ball where the portion of the thread passes tangentially to the central opening in the ball end. It is believed that the combination of these two features is of critical importance to the efficient operation of the invention in that by reducing the weight exerted on the tangentially wrapped thread at the ends of the ball and by maintaining the angle of thread withdrawal in a direction toward the operator, the thread at the end of the ball tends to be maintained at its original position tangent to the central opening at the end rather than to be displaced therefrom to a position behind and below the central axle. By preventing this latter displacement, the thread at the ball ends is in a better position to withstand the tension necessary to rotate the ball 180° without tying up around the axle.

As will be readily understood by those skilled in the art, an equally effective embodiment of the present invention may be fabricated in which the axle 24 is non-rotatably held by arms 20 and 22 and in which the mounting stems 30 are mounted to the arms, or even to the base 10, such that the fairlead support shaft portion 29 is rotatable about a portion of the surface of the ball. As will also be understood, the embodiment discussed may be rotated through 90° and the vertical portion 14 used as a base with the elimination of horizontal portion 12 without disturbing the efficient functioning of the dispenser. Furthermore there is no critical need for spacer 18, and a unitary base such as 14 having the arms 20 and 22 extending directly therefrom would be equally suitable. Finally, the inventive dispenser may function equally well in the instance where only one axle support arm 20 or 22, or only one of the mounting stem portions 30 is present so long as the spacial integrity of the remaining parts is maintained and a fairlead stop means (not shown) is placed on the free end of shaft 29, which in the disclosed embodiment, is either of the junctions of shaft 29 and bent stems 30.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. An improved dispenser for a strand, which strand has been twine-wound about a hollow spool to form a ball having a central hollow longitudinally therethrough, comprising:

a. ball mounting means for horizontally and rotatably mounting a spool of a ball of strand;

b. fairlead support means having a first elongated mounting stem portion having opposite end portions with one of said end portions being connected to said ball mounting means adjacent an end of a spool and the other of said end portions being located outwardly of said ball mounting means, said fairlead support means further having an elongated shaft portion connected at one end to said other end of said mounting stem portion and extending generally parallel to a ball, said shaft portion extending at least substantially the length of a ball and terminating in another end;

c. said ball mounting means including means for mounting said fairlead support means on said ball mounting means for rotational movement about a ball;

d. fairlead means reciprocably and rotatably carried on said fairlead support shaft portion; and e. said fairlead support means having stop means adjacent said other end of said fairlead support shaft portion engageable by said fairlead means for retaining said fairlead means being carried on said fairlead support shaft portion.

2. The dispenser as set forth in claim 1 wherein said ball mounting means comprises a base, and wherein said means for mounting comprises an elongated axle support arm mounted to said base and extending outwardly therefrom, an elongated ball mounting axle mounted to said axle support arm adjacent its outward end thereof in substantially horizontal orientation.

3. The dispenser as set forth in claim 2 wherein said mounting stem portion is connected to said axle.

4. The dispenser as set forth in claim 2 wherein said elongated ball mounting axle has a length greater than a longitudinal hollow of a ball and wherein said mounting stem portion is connected to one end of said elongated ball mounting axle.

5. The dispenser as set forth in claim 2 wherein said elongated ball mounting axle is rotatably mounted to said axle support arm so as to be rotatable about the longitudinal axis of said ball mounting axle.

6. The dispenser as set forth in claim 5 wherein said elongated ball mounting axle has a length greater than a longitudinal hollow of a ball and wherein said mounting stem portion of said fairlead support means is rigidly mounted to said elongated ball mounting axle adjacent one end of said axle.

7. The dispenser as set forth claim 6 wherein said elongated ball mounting axle has a first hole therethrough adjacent one end of said axle and substantially transverse to the length of said axle, said hole adapted to accept a portion of said mounting stem portion therein and wherein said mounting stem portion is rigidly mounted to said axle by insertion in said first hole.

8. The dispenser as set forth in claim 7 wherein said elongated ball mounting axle has a second hole therethrough adjacent the end of said axle opposite that having said first hole, and wherein said stop means is defined by a second elongated mounting stem portion extending from said fairlead support shaft portion and rigidly mounted to said ball mounting axle by insertion in said second hole.

9. The dispenser as set forth in claim 8 additionally comprising a second elongated axle support arm rigidly mounted to said base and extending outwardly therefrom and rigidly rotatably connecting to and carrying the end of the ball mounting axle opposite to the end rotatably carried by said first axle support arm.

10. The dispenser of claim 9 wherein said first and second elongated axle support arms are parallel to each other; and wherein said first and second holes in said elongated ball mounting axle are parallel to each other; and wherein said first and second mounting stem portions are parallel to each other and normal to said fairlead support shaft.

* * * * *